US005612475A

United States Patent [19]

Miemietz et al.

[11] Patent Number: 5,612,475

[45] Date of Patent: Mar. 18, 1997

[54] CARBOXYMETHYLATED GUAR GALACTOMANNAN AS A SIZING AGENT

[75] Inventors: Hans P. Miemietz, Moenchengladbach; Kaspar Schlueter, Solingen; Siegrid Waltenberger-Scharffetter, Breitscheid; Bernhard Wuestnienhaus, Erkelenz, all of Germany

[73] Assignee: Henkel Kommanditgesellschaft auf Aktien, Duesseldorf, Germany

[21] Appl. No.: 564,260

[22] PCT Filed: Jun. 15, 1994

[86] PCT No.: PCT/EP94/01948

§ 371 Date: Dec. 20, 1995

§ 102(e) Date: Dec. 20, 1995

[87] PCT Pub. No.: WO95/00696

PCT Pub. Date: Jan. 5, 1995

[30] Foreign Application Priority Data

Jun. 24, 1993 [DE] Germany ..... 43 21 016.3

[51] Int. Cl.[6] ..... C08B 37/00; C07H 1/00; C07H 23/00; C07H 13/02

[52] U.S. Cl. ..... 536/114; 536/119; 536/121; 536/123; 536/124

[58] Field of Search ..... 536/114, 119, 536/121, 123, 124

[56] References Cited

U.S. PATENT DOCUMENTS

| | | | |
|---|---|---|---|
| 2,477,544 | 7/1949 | Moe | 260/209 |
| 2,520,161 | 8/1950 | Owen | 260/209 |
| 4,011,393 | 3/1977 | Trepasso | 536/114 |
| 4,031,306 | 6/1977 | Demartino et al. | 536/114 |

FOREIGN PATENT DOCUMENTS

| | | |
|---|---|---|
| 0040335 | 11/1981 | European Pat. Off. . |
| 3709698 | 10/1988 | Germany . |

OTHER PUBLICATIONS

Textil Praxis International, vol. 48, No. 5, May 1993, Leinfelden De pp. 408–411, XP362784 Dr. Kaspar Schluter "Galaktomannane–eine zukinftsorientierte Schlichteklasse".

Melliand Textilberichte Aug. 1983, 526–529.

*Primary Examiner*—John Kight
*Assistant Examiner*—Everett White
*Attorney, Agent, or Firm*—Ernest G. Szoke; Wayne C. Jaeschke; Real J. Grandmaison

[57] ABSTRACT

A process for sizing natural and synthetic yarns by contacting the yarns with a sizing agent containing alkali metal salts of carboxymethyl guar galactomannan having degrees of substitution below 0.15.

20 Claims, No Drawings

CARBOXYMETHYLATED GUAR GALACTOMANNAN AS A SIZING AGENT

BACKGROUND OF THE INVENTION

This invention relates to the use of alkali metal salts of carboxymethyl guar galactomannan with degrees of substitution below 0.15 as sizing agents (sizes) and to a process for sizing natural and/or synthetic yarns using these compounds.

FIELD OF THE INVENTION

It is known that sizes are used in weaving to provide the warp filaments with sufficient strength and, on the other hand, to stick small projecting fibers to the main body of yarn or, in the case of filament yarns, to bond the individual filaments to one another. This increases the level of stress which the warp filament is capable of withstanding during weaving. Well-known sizes are native or modified starches, carboxymethyl celluloses, polyvinyl alcohols and polyacrylates. In general, the sizes have to be removed from the woven fabric after weaving because otherwise they would affect the subsequent finishing processes. One way of removing the sizes is simply to wash them out with water which presupposes that the sizes can be removed by washing with water. Sizes with this property are, in particular, carboxy-methyl-substituted starches, carboxymethyl celluloses, polyvinyl alcohols and polyacrylates. Except for the carboxymethyl-substituted starches, however, the other sizes show inadequate biological degradability. Although carboxymethylated starches are readily biodegradable, their sizing effect is unsatisfactory so that they have to be used in large quantities with the result that the advantage of ready biodegradability is partly offset.

The inadequate biological degradability of the other sizes is a particular disadvantage insofar as sizes make up most of the wastewater pollution caused by the textile industry. Thus, it is assumed that sizes cause up to 80% of textile wastewater pollution. Accordingly, there has been no shortage of attempts to find highly efficient sizes which can readily be removed by washing with water and which show improved biodegradability.

DISCUSSION OF THE RELATED ART

In Melliand Textilberichte 8/1983, 526–529, for example, various galactomannans, including guar galactomannans, are described as sizes. This article mentions the advantages and disadvantages of galactomannan sizes and also their ready biodegradability. Sizes of guar galactomannan, tamarind seed flour and carob seed flour (carubin) are mentioned as examples of galactomannan sizes. However, it is maintained in the article in question that, on account of their inadequate adhesive strength, galactomannan sizes are not a reasonable alternative to the sizes used hitherto. Moreover, carboxymethyl derivatives of guar galactomannan are not mentioned in the article.

Accordingly, the problem addressed by the present invention was to provide more readily biodegradable sizes which could be removed by washing with water and which, in addition, would be at least comparable with or even better in their sizing effect than the sizes used hitherto, such as carboxymethyl cellulose.

DESCRIPTION OF THE INVENTION

It has surprisingly been found that the problem stated above can be solved by using alkali metal salts of carboxymethyl guar galactomannan with degrees of substitution below 0.15 as sizing agents.

Applicants' own investigations have shown that special guar galactomannan derivatives, namely the alkali metal salts of carboxymethylated guar galactomannan, show good adhesive strength and ready biodegradability when they have a low degree of substitution.

Accordingly, the present invention relates to the use of alkali metal salts of carboxymethyl guar galactomannan with degrees of substitution below 0.15 as sizing agents for sizing natural and/or synthetic yarns.

In the context of the present invention, the terms carboxymethylated guar galactomannan and carboxymethyl guar galactomannan are synonymous.

Guar galactomannan products are produced from the endosperm of guar seeds. Native guar products consist of galactomannans with small quantities of protein, fiber and fat and also very small quantities of alkali metals and alkaline earth metals, iron and certain trace elements. The chemical structure of the galactomannans in guar galactomannan is described as a linear mannose chain, the mannose units being condensed with one another by (1–>4)-β- glycoside bonds and every second mannose unit carrying a galactose unit through substitution of the hydrogen of the primary hydroxyl group. The galactose molecule is joined to the main mannan chain by a (1–>6)-α- glycoside bond. The two sugar units have hydroxyl groups in the cis position in contrast to glucose, the monomer of cellulose and starch which all have hydroxyl groups in the trans position. The cishydroxyl groups and the stretched rigid structure of galactomannan are responsible for many unique properties of guar galactomannan and its derivatives. Guar galactomannan can be modified in the same way as other polysaccharides. One form of modification is carboxymethylation, in which case anionic guar galactomannan derivatives are formed. The carboxymethylation may be carried out in accordance with U.S. Pat. No. 2,520,161 and U.S. Pat. No. 2,477,544 by reaction of the guar galactomannan with a cold aqueous solution of alkali metal hydroxides and subsequent treatment of the alkali metal derivatives of the guar galactomannan with a halogenated fatty acid or a salt thereof. The carboxymethylation may also be carried out with other carboxylic acids or salts thereof, for example with glycolic acid or with sodium glycolate. Different degrees of substitution of the guar galactomannan are obtained according to the quantities of reactants used and the reaction times and conditions. The maximum possible degree of substitution is 3. Alkali metal salts of carboxymethyl guar with degrees of substitution of 0.05 to 0.15 are particularly preferred for the purposes of the present invention.

According to DE 37 09 698, carboxymethylated guar galactomannan with degrees of substitution of 0.22 is used as a size in the form of a mixture of hydroxyalkyl guar galactomannan and hydroxyalkyl cassia galactomannan. According to the present invention, however, it is intended to use alkali metal salts of carboxymethylated guar galactomannan with low degrees of substitution because applicants' own tests have shown that their adhesive strength is significantly better and their biodegradability is also superior.

Guar galactomannan products have molecular weights of 0.5 to $11.10^6$. In the event of modification, such as carboxymethylation, the guar galactomannan products are generally depolymerized at the same time. Since practical difficulties are involved in determining the molecular weight of such polymers, it is now standard practice to characterize the polymers by their viscosity and no longer by their molecular weight. One embodiment of the present invention uses alkali metal salts of oxidatively degraded carboxymethyl guar galactomannan which has a Höppler viscosity in the form of a 4% by weight aqueous solution at 20° C. in the range from 10 to 3,000 mPa.s and preferably in the range from 20 to 500 mPa.s.

As a result of the production process according to the two U.S. patents already cited, the alkali metal salts of carboxymethyl guar galactomannan can contain alkali metal halides as impurities. Accordingly, alkali metal salts of carboxymethyl guar galactomannan containing less than 10% by weight and preferably less than 5% by weight of alkali metal halide impurities are preferably used for the purposes of the invention. The alkali metal halide impurities can be reduced by methods known per se, for example by washing out with a mixture of methanol and water. Another impurity which can occur as a result of the production processes mentioned above are the salts of glycolic acids which can also be removed, for example, by washing with a mixture of methanol and water.

Of the alkali metal salts of the carboxymethyl guar galactomannans, the corresponding sodium salt is particularly preferred.

According to the invention, the alkali metal salts of carboxymethylated guar galactomannan may be used either on their own or in the form of mixtures with conventional sizes, preferably starch derivatives, polyvinyl alcohols and polyacrylates. The mixing ratios are selected according to the required size properties and lie within the limits familiar to the expert.

The alkali metal salts of carboxymethyl guar galactomannan may be used in any weaving machines and in any sizing machines, such as shuttle, gripper and air jet weaving machines. Yarns in the context of the invention may be both staple fiber yarns and endless yarns. The yarns may be of natural origin, for example of cotton or regenerated cellulose, and/or synthetic origin, such as cellulose acetate, polyester, polyacrylonitrile and polyamide. Particularly good results are obtained for cotton and regenerated cellulose and blends thereof with polyester.

The size coating of alkali metal salts of carboxymethyl guar galactomannan with degrees of substitution below 0.15 either individually or in admixture with conventional sizes is in the range from 1 to 25% by weight, based on the dry weight of the yarn. The quantity in which the alkali metal salts of carboxymethylated guar galactomannan are used is thus of the order of one third to one half of 100 parts of starch size and, in the latter case, is thus in the range of known synthetic sizes.

Where the alkali metal salts of carboxymethyl guar galactomannan according to the invention are used, an excellent sizing effect is obtained. In addition, the alkali metal salts of carboxymethyl guar galactomannan have excellent biodegradability which is significantly better at these low degrees of substitution than in the case of guar galactomannans with only slightly higher degrees of substitution. Furthermore, the alkali metal salts of carboxymethyl guar galactomannan dissolve in water more quickly and without lumps, do not show any signs of skin formation, do not foam in the liquor and can be removed by washing with water.

The present invention also relates to a process for sizing natural and/or synthetic yarns in known manner with alkali metal salts of carboxymethyl guar galactomannan, characterized in that alkali metal salts of carboxymethyl guar galactomannan with degrees of substitution below 0.15 are used. The alkali metal salt of carboxymethyl guar galactomannan is applied in the same way as normal sizes in the form of an aqueous solution with product concentrations of 10 to 150 g/1 in conventional sizing machines.

EXAMPLES

A. Tested alkali metal salts of carboxymethyl guar galactomannan

| Ex. | Active content in % by weight | Water content in % by weight | NaCl content in % by weight | Degree of substitution | pH value, 4% by weight solution | Höppler viscosity, solution, 20° C. |
|---|---|---|---|---|---|---|
| A1 | 91.5 | 6.4 | 0.32 | 0.13 | 6.1 | 77 |
| A2 | 80.7 | 3.2 | 4.33 | 0.1 | 6.4 | 40 |
| Comp. 1 | 76.8 | 2.0 | 8.61 | 0.33 | 5.6 | 21 |

The Höppler viscosity was determined in accordance with DIN 53015. The above sodium salts of carboxymethyl guar galactomannan obtainable, for example, in accordance with U.S. Pat. No. 2,477,544 or U.S. Pat. No. 2,520,161 were tested.

B. Determination of the sizing effect

An abrasion tester of the type developed at the TNO Fiber Institute, Delft, NL was used to determine the sizing effect.

In this abrasion tester, 30 individual filaments are clamped in such a way that they can be subjected to combined filament-to-filament and filament-to-metal friction. The guide pins were mounted on a rail moved up and down by a motor. Tensile stress was provided by an attached 50 g weight. After abrasion until all the fibers had broken, the number of abrasion strokes being counted for each filament breakage, the test was statistically evaluated. The median value, which is characterized in that 50% of all values are above and 50% below this value, was used as a measure of the sizing effect.

The warp yarns were sized in a laboratory sizing machine of the type manufactured by the Sucker company of M önchengladbach, 40 filaments being sized from the creel. Raw white cotton ring-spun yarns with a count of 50/1 were routinely used.

The test was carried out under the following conditions:

| Test conditions | |
|---|---|
| Yarn | count 50/1, CO ring |
| Setting | 30 filaments/cm |
| Dipping roller | 140 daN |
| Squeezing roller | 0.5 bar (large manometer) |
| Temperature trough | around 85° C. |
| Temperature drying | around 130° C. |
| Speed | around 30 m/min. |

The abrasion resistances observed at various size contents (according to DIN 54285), expressed as the number of strokes up to filament breakage (median value), are shown in Table 1.

TABLE 1

| Abrasion Resistance Table | | |
|---|---|---|
| g/l Product | Size content | Number of strokes |
| 30 A1) | 3.0 | 120 |
| 50 A1) | 5.0 | 336 |
| 90 A1) | 9.8 | 983 |
| 30 A2) | 3.4 | 81 |
| 50 A2) | 5.0 | 205 |
| 80 A2) | 8.9 | 596 |
| 30 Comp. 1) | 3.4 | 76 |
| 50 Comp. 1) | 4.9 | 142 |
| 90 Comp. 1) | 9.3 | 385 |
| 120 Comp. 1) | 13.4 | 607 |
| 30 Comp. 2) | 2.9 | 95 |
| 50 Comp. 2) | 4.8 | 187 |
| 90 Comp. 2) | 9.6 | 481 |

It can be seen from Table 1 that the sodium salt of carboxymethylated guar galactomannan with relatively high degrees of substitution (Comp. 1) shows a poorer sizing effect for the same size contents as or higher size contents than those with degrees of substitution below 0.15 because filament breakage occurs after only a few strokes. Table 1 also shows that the sodium salts of carboxymethyl guar galactomannan (A1) and A2)) are clearly superior in their sizing effect to the carboxymethyl cellulose derivative used hitherto, namely Horsil NV-P (Registered Trademark of Henkel KGaA (Comp. 2)).

C. Biological degradability

An accelerated Zahn-Wellens Test (ZWT) was carried out to determine biological degradability. The test matrix was hardened distilled water to which wet sludge was added in a quantity corresponding to around 1 g/l dry matter. The whole was incubated for 7 days at 90° to 25° C. with stirring in the presence of air. Regular DOC measurements were taken. The results for A1) and Comp. 1) are shown in Table 2.

TABLE 2

| Biological Degradability | | | | | |
|---|---|---|---|---|---|
| Test | Test concentration | Percentage DOC reduction after days, based on the 0-hour value | | | |
| substance | rag DOC/1 | 0.25 | 1 | 3 | 7 |
| A1) | 100 | 5 | 23 | 90 | 93 |
| Comp. 1) | 100 | 4 | 3 | 30 | 70 |

It can be seen from Table 2 that the compounds used in accordance with the invention show far better degradability than the guar galactomannan derivatives with slightly higher degrees of substitution.

We claim:

1. A process for sizing natural and synthetic yarns comprising contacting said yarns with a sizing agent comprising an alkali metal salt of carboxymethyl guar galactomannan having a degree of substitution below 0.15.

2. The process of claim 1 wherein said sizing agent has a degree of substitution from 0.05 to below 0.15.

3. The product of the process of claim 2.

4. The process of claim 1 wherein a 4% by weight aqueous solution of said alkali metal salt of carboxymethyl guar galactomannan has a Höppler viscosity of from 10 to 3,000 mPa.s at 20° C.

5. The process of claim 4 wherein said alkali metal salt of carboxymethyl guar galactomannan has a H6ppler viscosity of from 20 to 500 mPa.s at 20° C.

6. The product of the process of claim 5.

7. The product of the process of claim 4.

8. The process of claim 1 wherein said alkali metal salt of carboxymethyl guar galactomannan contains less than 10% by weight of alkali metal halide impurities.

9. The product of the process of claim 8.

10. The process of claim 1 wherein said sizing agent further contains conventional sizes selected from the group consisting of starch derivatives, polyvinyl alcohols, polyacrylates, and mixtures thereof.

11. The product of the process of claim 10.

12. The process of claim 1 wherein said natural and synthetic yarns are applied with from 1 to 25% by weight of said sizing agent, based on the dry weight of said yards.

13. The product of the process of claim 12.

14. The process of claim 1 wherein said natural and synthetic yarns are selected from the group consisting of cotton, regenerated cellulose, polyester, and mixtures thereof.

15. The product of the process of claim 14.

16. The process of claim 1 wherein said alkali metal salt of carboxymethyl guar galactomannan is the sodium salt.

17. The product of the process of claim 16.

18. The process of claim 1, wherein said sizing agent is applied to said yarns as an aqueous solution containing from 10 to 150 g/l of said alkali metal salt of carboxymethyl guar galactomannan.

19. The product of the process of claim 18.

20. The product of the process of claim 1.

* * * * *